United States Patent [19]

Michaels et al.

[11] 3,950,680

[45] Apr. 13, 1976

[54] ELECTROSTATOGRAPHIC DIAGNOSTICS SYSTEM

[75] Inventors: Thomas B. Michaels, Pittsford; George H. Place, Jr., Webster, both of N.Y.

[73] Assignee: Xerox Corporation, Stamford, Conn.

[22] Filed: Apr. 28, 1975

[21] Appl. No.: 572,683

[52] U.S. Cl. ..... 317/262 A; 250/324

[51] Int. Cl.[2] ..... G03G 15/02

[58] Field of Search ..... 317/262 A, 4; 250/324, 250/325, 326

[56] References Cited

UNITED STATES PATENTS

| | | | |
|---|---|---|---|
| 3,496,351 | 2/1970 | Cunningham, Jr. | 250/326 |
| 3,678,350 | 7/1972 | Matsumoto et al. | 317/262 A |
| 3,769,506 | 10/1973 | Silverberg | 317/262 A |

*Primary Examiner*—R. N. Envall, Jr.

[57] ABSTRACT

In an electrostatographic copying system, where a common imaging surface is subjected to currents from several corona generators during copying, the actual output current of each corona generator is individually measured, and controlled, utilizing individual current measurement resistive paths between the low voltage sides of discrete power supply circuits provided for each corona generator and a common ground path from the imaging surface, and by individually feeding back the shield current of each corona generator in a feedback path separate from the current measurement path. A.C. lead feedback, and switching and measurement circuitry are also disclosed.

13 Claims, 2 Drawing Figures

ELECTROSTATOGRAPHIC DIAGNOSTICS SYSTEM

Figure 1:
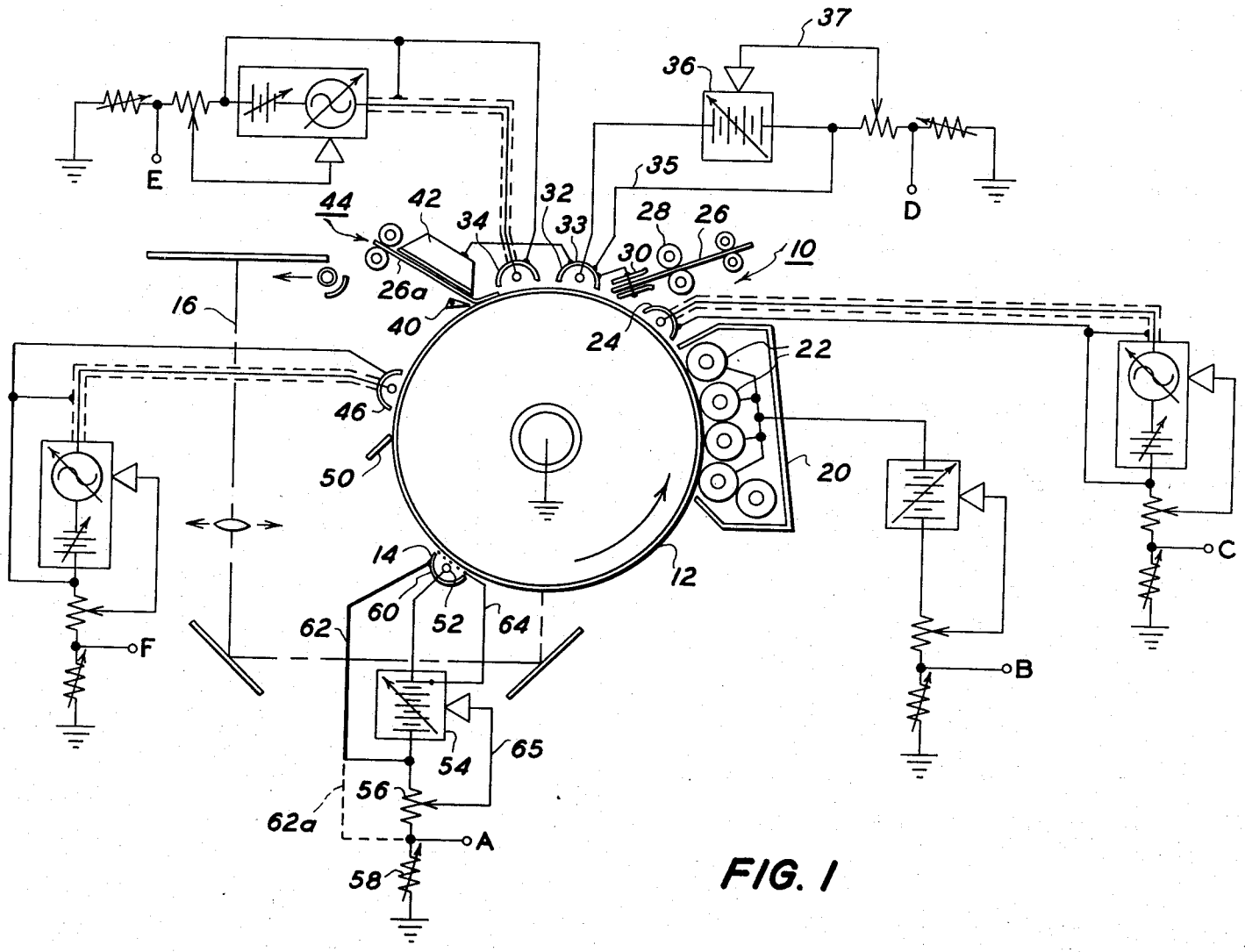

The present invention relates to corona charge generating systems in electrostatographic copying, and more particularly to an improvement in the measurement of said corona charging.

In the electrostatographic copying, particularly xerography, it is well known to use several different corona generators for applying different electrostatic charges to an imaging surface. These charges are generally applied for several different and/or simultaneous functions on a single imaging surface. Examples are corona generators utilized for: initial charging of a photoreceptor, pre-transfer, transfer, sheet detack, pre-cleaning, etc..

Many of these corona generators in electrostatography utilize a conductive shield partially surrounding the high voltage biased corona generating electrode wire, as in a corotron. U.S. Pat. No. 2,836,725, issued May 27, 1958, to R. G. Vyverberg is noted. Biased conductive control screens may also be imposed between the corona generating electrode elements and the surface to be charged, as in a scorotron. U.S. Pat. No. 2,777,957, issued Jan. 15, 1957, to L. E. Walkup is noted. Various input current sensing and control arrangements are known for corona generators.

The shield which is generally located closely adjacent the corona generating electrode element usually draws charges from the corona generating element and conducts away a substantial (if not major) portion of the total output current generated by that corona electrode. That is, the shield substracts a substantial portion of the total corona generator input current. The functional or useful output is only that portion of the corona charge output current escaping the shield (and screen, if any) which actually goes to the surface to be charged.

It is known that the total output level of the corona generating element, and also the relative percentage of this output which goes to the shield versus the percentage which goes to the imaging surface to be charged, are all varying in some degree during the operation of the copying apparatus even if the input voltage is held constant. They are being affected by the charge previously placed on the imaging surface, humidity, atmospheric pressure, contamination and oxidation, the rate of movement of the surface being charged, etc.. It is known that controlling or measuring the total input current to a corona generator is generally not a sufficiently accurate measurement or control of the actual output current of the corona generator to the surface being charged. Accordingly, various arrangements have been previously known to more directly control or measure the output of the xerographic corona generator.

One well known conventional corona generator output measurement system consists of substituting a conductive test "shoe" surface for the portion of the photoreceptor imaging surface normally under and charged by that corona generator. Then the current received from each corona generator by the conductive shoe is individually measured. The total input power supplied to that corona generator is then adjusted to give the desired "shoe" current. Then the "shoe" is moved under another corona generator and the process repeated. This system requires removal of the imaging surface, substitution of a different and not fully equivalent surface, and only allows independent and unrelated adjustment of each corona generator.

In reality in an operating xerographic apparatus the outputs of the different corona generators influence one another. This is because the charge applied by one corona generator to the imaging surface can change the output of other corona generators downstream therefrom in the path of the same imaging surface. This is a variable affected by the conductivity of the imaging surface which varies with "dark decay," etc. Closely spaced corona generators can affect each others current directly. In the transfer station, the output of the transfer and detack corona generators can often influence each other, and both are influenced by the presence or absence and conductivity of the copy sheet. Copy sheet conductivity varies greatly with humidity and materials. Also, a significant portion of the transfer current applied to the copy sheet can conduct laterally along the copy sheet in many cases.

Another known method of measuring or controlling the output of a corona generator is to electrically "float" the imaging surface and its conductive substrate above electrical ground, for example, to mount a xerographic photoreceptor drum on insulated bearings and make electrical connection thereto with a slip ring. A current measuring device can then be placed between the "floating" photoreceptor substrate and ground. Then one corona generator at a time can be turned on and its output current to the photoreceptor measured by this current measuring device in the ground path for the drum. This measuring arrangement has the obvious disadvantage of requiring an ungrounded imaging surface substrate. It also has the same disadvantages as the previously described measurement system in that the interdependent effects of the corona generator outputs on one another cannot be measured. This is because if more than one corona generator were operated simultaneously the current measurement device in the drum ground path would read the sum of their outputs and would not be able to discriminate between them. Thus, this system also cannot be utilized to measure the true normal operating or "dynamic" currents of the individual corona generators in the normal copying operation of the copying apparatus. Examples of such electrically floating plate charge control systems are disclosed in U.S. Pat. Nos. 3,335,275, issued Aug. 8, 1967 to P. F. King, and 3,335,274 issued Aug. 8, 1967 to J. J. Codichini, et al.

It is known that the actual charge present on an imaging surface due to a corona generator output can be measured during a machine copying operation by an electrometer probe measurement of the charge on an area of the imaging surface downstream from the corona generator or by the corona output sensed by an electrometer placed under the corona generator. Examples of such systems include those disclosed in U.S. Pat. No. 3,835,380 issued Sept. 10, 1974 to T. J. Webb and the reference listed therein; and U.S. Pat. Nos. 3,586,908 to R. Vosteen, 3,678,350 to S. Matsumoto, et. al., and 3,667,036 to N. Seachman. This charge measurement can be beneficially utilized to control various corona generator outputs or the like. However, these electrometer systems obviously require the use of electrometers, and they occupy valuable space around the imaging surface and can only measure the charge in the position in which they are located. It is not economically or spacially desirable to provide several electrometers for measuring the charge on the imaging surface downstream of most of the corona generators in a copying apparatus. Moving an electrometer between different locations takes time and does not allow simultaneous measurements.

It is known that the conductive shield and/or screen of a corona generator can be electrically isolated above ground, and electrically connected back to a part of the power supply and/or used as part of an output control, e.g., U.S. Pat. No. 3,699,388, issued Oct. 19, 1972, to T. Ukai, noting especially Col. 3, lines 22–32. [Its British equivalent Patent is No. 1,235,497 to K. K. Ricoh, noting there the last sentence of the description.] Sensing electrodes controlling the corona generator are taught in this 3,699,388 patent, and in U.S. Pat. Nos. 3,604,925, issued September 14, 1971, to C. Snelling, and 3,819,942, issued June 25, 1974, to P. Hastwell, et al.

Particularly noted is the corona generator control circuit of U.S. Pat. No. 3,062,956 to J. Codichini, Nov. 6, 1962. Also, U.S. Pat. Nos. 2,868,989 to A. C. Haacke, Jan. 13, 1959; 3,244,083 to R. Gundlach, Apr. 5, 1966; 3,557,368 to T. Tano, Jan. 19, 1971; 3,769,506 to M. Silverberg, Oct. 30, 1973; and 3,805,069 to D. H. Fisher, Apr. 16, 1974.

The present invention overcomes many of the above-discussed disadvantages and allows for the accurate measurement and control of the actual output currents of the individual corona generator in a copying apparatus under dynamic operating conditions. That is, the actual output current of a given corona generator can be measured while the copying apparatus is operating normally with other corona generators also applying their charges to the imaging surface, to a copying sheet thereon, etc. Further, with the present system the imaging surface and its substrate can be conventionally grounded.

Basically, in the present system the portion of each corona generator current going to its conductive shield is substracted from the total input current supplied to that corona generator to provide a measurement of the current actually going from the corona generator to the imaging surface or plate. This is based on the principle that the total input current supplied to the corona generator must go to either the imaging surface or the shield, and that if the shield current is electrically floated slightly above ground it can be fed back and subtracted to achieve the measurement of the true plate (imaging surface) current, and therefore the current applied charge. This measurement of the true charging current can then be utilized for maintaining the true dynamic charging current constant by changing the corona generator input current. This measurement may also be utilized for various other diagnostic or control purposes, manually or automatically, as taught by various above-cited references.

The system disclosed herein may be utilized with various types of corona generators, imaging surfaces and xerographic or other electrostatographic systems. Details of various suitable exemplary such systems and structures and their functions and materials are well known to those skilled in the art, and the references referred to in this specification may be incorporated by reference, where appropriate, if desired, for such details. The following description is therefor primarily limited to one example of the novel aspects of the present invention.

Figure 2:
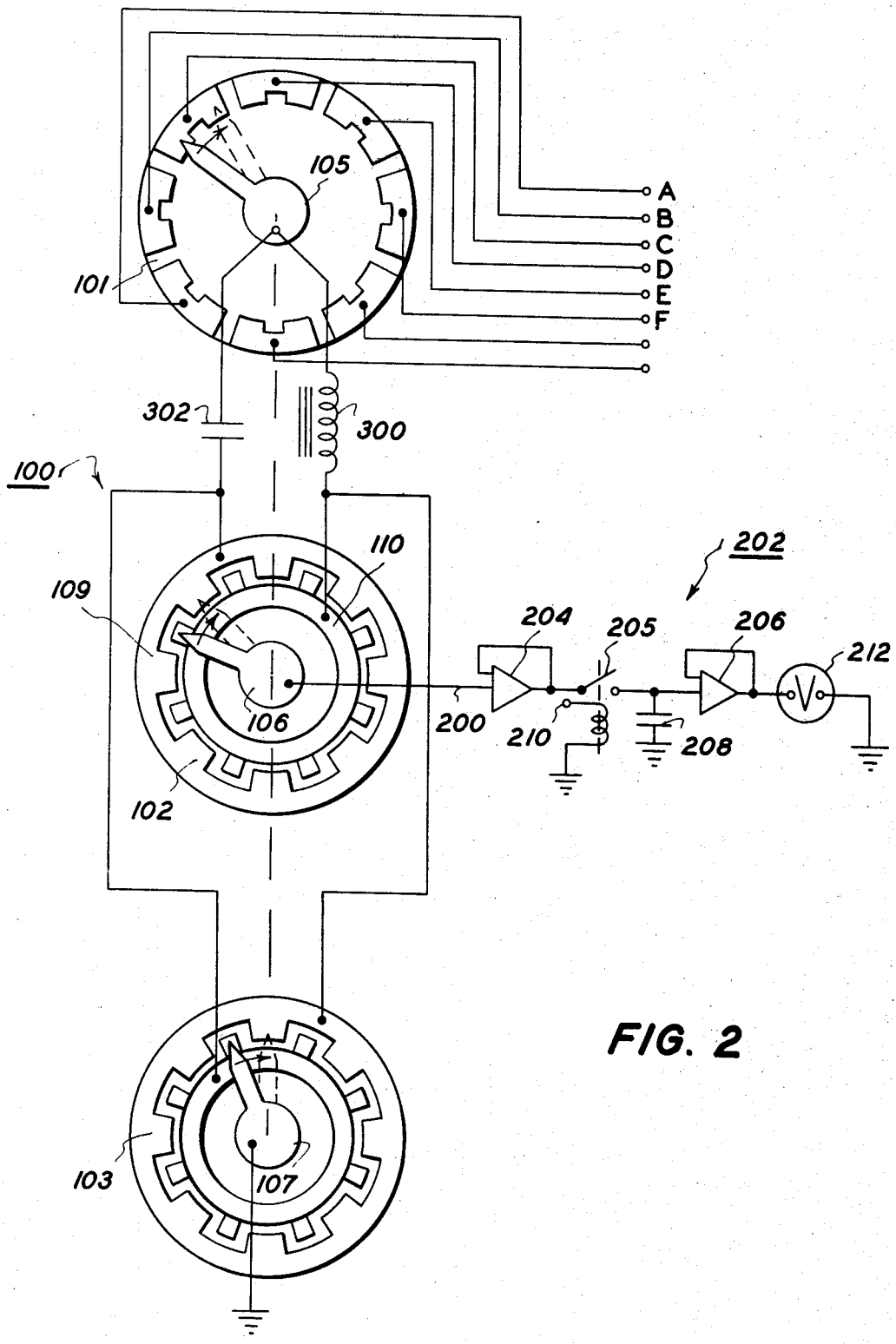

Further objects, features and advantages of the present invention pertain to particular apparatus, details and steps whereby the above-mentioned aspects of the invention are attained. Accordingly, the invention will be better understood by reference to the following description of an example thereof, and to the drawings forming part of the description wherein:

FIG. 1 is a schematic view of an exemplary electrostatographic copying system incorporating the corona charge generating systems in accordance with the present invention; and FIG. 2 is a related schematic view of circuitry connecting with the circuitry of FIG. 1, illustrating details of an exemplary measurement and selective switching circuitry.

Referring now to the embodiment of FIGS. 1 and 2, there is shown in FIG. 1, an exemplary electrostatographic copying system 10 in which images are formed and developed on, and then transferred from, a photoconductive surface 12. This imaging surface 12 is shown being acted upon (charged or discharged by) various controlled corona generating devices, as will be described further herein. The configuration, number and type of these corona generating elements per se and the xerographic arrangements may all be conventional.

Briefly describing in sequence the schematically illustrated operating stations of the xerographic system 10 in FIG. 1, the imaging surface 12 is uniformly initially charged by a charging scorotron 14. A latent image is then next formed on the imaging surface 12 by optically exposing the imaging surface through an optical document scanning system 16 which selectively discharges the imaging surface 12 in the document image pattern. See e.g. U.S. Pat. No. 3,775,008. The electrostatic latent image on the imaging surface 12 is then conventionally developed here with particulate toner material in a magnetic brush development station 20 containing a plurality of rotating magnetic developer rollers 22. These developer rolls 22 are electrically biased to produce an electrical field between themselves and the imaging surface 12, rather than a corona charge output.

The imaging surface 12 is next subjected here to A.C. (with a D.C. bias) corona emissions from a pretransfer corona generator 24. The developed and pre-treated toner image is then carried on the imaging surface 12 into the transfer station, where it is overlaid with a copy sheet 26 fed into registration with the toner image by conventional copy sheet feed means 28 through conventional conductive sheet guide members 30. The opposite side of the copy sheet 26 from the side in engagement with the imaging surface 12 is subjected to transfer charges by a conventional D.C. transfer corona generator 32 to effect image transfer to the copy sheet of the toner particles. Then, to assist in stripping of the copy sheet from the imaging surface, the copy sheet is subjected, immediately downstream from the transfer corona generator 32 to an A.C. (Possibly D.C. biased) detacking corona generator 34.

Stripping of the copy sheets is illustrated here by a second copy sheet **26*a* shown being stripped from the imaging surface 12 by a conventional stripper finger 40. The copy sheet 26*a* is shown slidably supported by a known vacuum shoe 42 guiding the copy sheet 26*a* into the nip of a pair of rollers forming the image fusing station 44. (See e.g. U.S. Pat. No. 3,578,859 issued May 18, 1971 to W. K. Stillings.) Finally, the imaging surface 12 is subjected to A.C. corona emissions from a preclean corona generator 46 prior to the residual toner being removal therefrom by a conventional cleaning blade 50.**

As may be seen from FIG. 1, electrically independent power supplies are provided for each of the above-described corona generators. Each corona generator power supply here is electrically isolated from one another and is also isolated from ground. However, each power supply has one terminal connected to ground through a resistance circuit as will be further described herein. These respective variable D.C., or variable A.C. with variable D.C. bias, power supplies are all illustrated schematically here since such circuits are well known. Reference may be had to the various references cited herein.

It will be appreciated that various components of these illustrated power supplies can be shared, in whole or in part, between the various corona generators, as long as the currents from electrical ground can be measured individually for the individual corona generators. For example, common transformers can be utilized with separate secondary windings providing the electrical input to the discrete power supplies. Note, for example, U.S. Pat. No. 3,275,837 to J. J. Codichini et al. issued Sept. 27, 1966.

It will also be appreciated that although individually shielded corona generators are illustrated here that it is well known that jointly or commonly shielded corona generators may be utilized in certain situations. It is also well known that the term corona generator includes multiple wire or needle array corona generating elements as well as the single wire corona generators illustrated here.

It will be particularly noted that each of the corona generator conductive shields here is individually electrically isolated from one another and also isolated from both the imaging surface 12 and from electrical ground. Instead, each corona generator shield is connected by an individual feedback circuit only to the respective individual power supply for that individual corona generator. Thus, this shield current feedback circuit is electrically isolated from both the imaging surface and from electrical ground. This feedback circuit feeds the shield current directly back to the corona generator power supply.

As noted above, this shield current is the variable portion of the input current to the corona generator electrode which flows to the shield of that corona generator rather than to the imaging surface. Feeding back this shield current is in contrast to conventional xerographic systems in which most of the corona generator shields are generally electrically grounded. Here, the shield currents are returned to the electrical ground or "low" side of their power supplies, i.e., the shields are at a low voltage potential. However, the ground side of each power supply here is slightly above ground for measurement purposes, connecting with ground only through a measurement resistance circuit. This resistance circuit provides a voltage drop across its resistance which is a direct function of the current passing between that power supply and electrical ground. This ground path current here is a measure of the actual output current of the corona generator to the imaging surface 12. This is because all of the corona generator to imaging surface current (known as "plate current") can return to each power supply ground terminal only through the current measurements circuit provided by this resistive ground path. This is because of the electrically "floating" isolation of each power supply above ground. Significantly, the shield current of each corona generator does not return through this ground path, because it has a separate current loop or return path to the power supply itself, above the current measurement circuit.

To restate the above description, each corona generator here has two separate current loops. One current loop is from the high voltage side or terminal of each individual power supply to its connecting corona electrode, thence (through air ionization) to the shield of that corona generator, and thence through a feedback circuit back to the low side of the same power supply, as previously described. The other, and separate, current loop is from the same high side of the power supply to the same corona generator electrode and thence (through air ionization) to the imaging surface 12 (the xerographic plate) and thence, through the grounded substrate of the imaging surface 12, to the machine electrical ground, and then through that ground and up through the resistive current measurement circuit to the low side of the same power supply. The current measurement circuit (to be described subsequently herein) is located only in this second above-described current loop. It may be seen that all of the output current from the corona generator electrode to the imaging surface, but none of the shield current, is passed through the current measurement circuit in this second current loop.

The imaging surface 12 here is conventionally, and desirably, grounded by having a grounded electrically conductive substrate directly connected to the machine frame electrical ground. The imaging surface 12 can comprise a conventional thin integral overlay of photoconductive material on this electrically grounded substrate. Thus, all of the charges conducted off of the imaging surface 12 are conducted directly to ground through this substrate. Thus, all of the plate currents from the various corona generators are co-mingled together indistinguishably in this common ground path through the conductive substrate of the imaging surface and machine ground. However, with the disclosed circuitry, these co-mingled currents are separated for discrete measurements in the individual returns to the individual power supplies. Thus, unlike the above-described prior art in which current is measured between an electrically floating drum and ground, here any or all of the corona generators can be operating simultaneously and yet their individual plate currents can be separately measured.

Although the corona generator shields here are not connected to ground directly, they are nevertheless maintained essentially at ground potential. They can have a voltage level only very slightly above ground corresponding to the small voltage drop through the current measuring resistor in the power supply ground path. This voltage corresponds to the corona electrode plate current times this resistance value. Thus, there is no safety hazard to the machine operator from contact with the shields. Likewise, there is no increased danger of arcing from the shield to the photoreceptor, and no significant increase in the toner attraction of the shield. It will be appreciated, of course, that the shield may be intentionally biased above ground level for other reasons in some cases, such as to control the corona generator output.

Referring now to an individual exemplary corona generator control circuit, the charging scorotron 14 circuit will be discussed. It may be seen that its corona emitting electrode 52 is directly connected by an electrical lead only to the high voltage side of a variable D.C. power supply 54. The low voltage side of the power supply 54 connects to electrical ground only through a resistance circuit comprising resistors 56 and 58 in series. Both of these resistors have low resistance values. They provide a small, but measureable, voltage drop thereacross from the corona generator plate current applied therethrough. It may be seen that the shield 60 of the corona generator 14 is connected by a lead 62 only to the same low side of the power supply 54, and is isolated above ground above the resistors 56 and 58.

This feedback circuit 62 for all of the shield current provides a first current loop through the power supply 54 for the shield current, as described above. Only the shield current can make a complete current loop through the lead 62. The actual current output of the corona generator 14 from the corona electrode 52 to the imaging surface 12 must return via the grounded substrate of the imaging surface to complete a second circuit from the high voltage side of the power supply 54 to its low voltage side. The only return path which is provided for this actual plate current here is through the resistive return path to the low side of the power supply 54 comprising the resistors 56 and 58, since that is the only ground connection of the power supply 54. Thus, all of the actual output current of the individual corona generator 14 is in this second and separate current loop and must pass through both the resistors 56 and 58. Further, no other corona generator current loops can be completed in the same current loop since they are from separate power supplies. Thus, the true output current of the corona generator 14, independently of its shield current, and independently of the other corona generators, can be measured at a reference tap A across the resistor 58. The voltage at point A relative to ground is equal to the actual output current to the imaging surface 12 of the corona generator 14 times the resistance of the resistor 58. This resistor 58 here is adjustable to allow for initial calibration and/or scale setting.

Because the exemplary corona generator 14 here is illustrated as a scorotron, unlike the other corona generators here it has an additional lead 64 providing a bias connection from the power supply 54 to the screen or grid wires of the scorotron. However, sincew these screen wires are non corona generating in themselves, any current in the lead 64 can be only that received from the corona generating electrode 52. The lead 64 feeds back all screen current to the power supply 54 in a separate current loop not affecting the output current return path through the resistor 58.

The above-described circuitry provides the described independent and accurate measurement of the true output of the corona generator 14. However, it may be seen that an additional resistance 56 and additional feedback lead 65 are also disclosed here. The feedback lead 65 connects at one end to a variable tap output from the resistor 56 and connects at the other end into the power supply 54 through a conventional control amplifier. This additional circuitry comprises a feedback circuit for automatically regulating and controlling the power supply 54 output. I.e., this feedback control circuit can regulate a selected pre-set output of the power supply 54 to the corona generator electrode 54, and thereby maintain a selected pre-set output current from the corona generator 14. This control circuit is responsive to changes only in the actual output current of the corona generator 14, irrespective of changes in the shield current, since the resistances 56 and 58 provide the only feedback control voltage signal, and this voltage drop only changes with the corona generator's actual output current. It will be appreciated that the separate feedback control resistor 56 here is not required and that the feedback lead 65 could be connected to the same point A and thus be responsive to the voltage only across the resistor 58 instead. However, by providing an additional variably tapped resistor 56, a separate sensitivity control and/or pre-set initial output level control can be provided. It will be appreciated, of course, that both the feedback circuit 65 and resistor 56 can be eliminated entirely if purely manual conventional control of the power supply 54 is desired. In that case, of course, the high end of the resistor 58 and the reference point A would be connected directly to the low (ground) side of the power supply 54.

Referring now to the other and independent power supplies and output measurement and control circuits of the other corona generators, it may be seen that they are for the most part basically similar, and the above description for the corona generator 14 can be basically applied to them. Their current measurement taps are respectively designated here as B, C, D, E, and F. However, B is not a corona current measurement. As noted above, these other corona generators do not have scorotron grid control wires and, therefore, do not have anything corresponding to the return lead 64.

The A.C. corona generators here are the pre-transfer corona generator 24, the detack corona generator 34 and the pre-clean corona generator 46. These have output taps C, E, and F, respectively. All of these A.C. corona generators here have electrically shielded leads connecting between the individual A.C. power supplies and their corona emitting electrodes to avoid A.C. current loss from the leads. The conductive shields of each lead are connected back in the same feedback return path as the corona generator shield currents. They may be commonly electrically connected to their corona generator shields. All of the alternating current loss from the leads is captured by the surrounding conductive shields for these leads and returned directly, to the low side of the respective power supplies, i.e., these lead shields are electrically isolated from ground, like the corona generator shield current path 62 previously described, to provide a current loop for these currents separate from the corona generator output.

It will be appreciated that the A.C. corona generators here may be of a type in which a dielectric shield is provided between the corona generating electrode and the conductive portion of the corona generator shield, as disclosed, for example, in U.S. Pat. No. 3,742,237, issued June 26, 1973, to D. G. Parker. It will also be appreciated that the A.C. corona generators may be of a type in which the corona shield is purely dielectric and there is no corona shield current at all and, therefore, no return current loop to the power supply. In that case, however, there would still preferably be a return current path for the conductive shielding of the electrical lead of the power supply to the corona generator.

To summarize, all high voltage A.C. cable loses are preferably individually collected by shields and returned to their respective power supplies for all A.C. corotrons. Otherwise, if A.C. currents from a power supply lead could escape to machine ground, it would return to the low side of the power supply through the current measurement loop (i.e., the resistive path between the low side of the power supply and ground). This would erroneously add to the measured output current of the A.C. corona generator.

Referring now to the developer station 20 and the illustrated circuitry for applying a D.C. bias to the developer rollers 22, it may be seen that a current measurement therefor is provided at an output tap D with a similar circuit arrangement to that described above for the corona generators. It will be appreciated that for this developer bias arrangement that it may not be desirable or necessary to provide feedback circuit corresponding to the lead 62 for the feedback of shield current, and none is illustrated. However, the illustrated circuit can provide at point D a voltage corresponding to the current passing from the development rollers 22 to the imaging surface 12, assuming that leakage to ground by other paths of the current to these rollers is not excessive. This arrangement is illustrated here to emphasize that although the primary function of the circuitry disclosed herein is for the accurate measurement of corona generator outputs, other apparatus imparting currents to the imaging surface 12 may be integrated into the same measurement scheme, including the integral measurement switching circuitry to be described hereinbelow. For example, another such a source of current to the imaging surface could be that from bias transfer roller system, such as that disclosed in U.S. Pat. No. 3,860,436. This is another example of a system in which a biased electrode means is applying a bias to the imaging surface, and in which it is desired to be able to selectively connect that biased electrode to the same current measurement circuit to measure its current to the imaging surface. The respective bias supply can be controlled by measurement of its power supply to ground current at a low voltage level rather than by having to measure its bias current at a high voltage level (e.g., at the output of its power supply), or between the plate and ground.

Considering now the transfer corotron 32, and its associated power supply and measurement circuit here, it may be seen that its power supply and measurement circuit is essentially identical to that previously described for the charging corona generator 14. However, there is a significant difference between the pre-transfer and post-transfer (stripping) areas of this xerographic system from that of a conventional xerographic system. All of the machine components which would normally contact the copy paper during the time the paper is in the transfer station are electrically insulated from ground and are directly connected to the shield 33 of the transfer corotron. Specifically, it may be seen that both the sheet guides 30 and the vacuum shoe 42 here are only directly electrically connected with the shield 33 to feed current back through the same feedback circuit 35 to the low side of the transfer power supply 36. The feedback circuit 35 is an equivalent of the feedback circuit 62 of the corona generator 14, i.e., it is by-passing the shield current back to the power supply in a different current loop than that of the measurement circuit providing an output at point D. Here the current in the feedback circuit 35 is not just the current induced in the shield 33 by the transfer corotron corona generator. It also includes all of the currents induced in the sheet contacting and guiding members 30 and 42. As with the shield 60 of corona generator 14, however, all of these components 30, 33, and 42 are charged, at most, slightly above ground potential to a voltage level corresponding only to the corona generator plate current times the measurement path resistance between all of those components and ground. That resistance is provided by resistors corresponding to the resistors 56 and 58, and can be less than 10,000 ohms. That is many times less than the impedance of the corotron 32 itself, i.e., the impedance between the corona generating electrode and its shield or the imaging surface. Maintaining the voltage level of all of these components at substantially ground potential has important advantages, as previously noted in regard to corona generator shields.

It will be appreciated that the component 30 and 42 here are merely exemplary of various conventional input and output sheet handling, guiding, feeding, or deflecting members for a xerographic transfer station. Any such members which contact a copy sheet while any part of the sheet is under the transfer corona generator could be connected in the same manner to the feedback circuit 35.

The problem to which the above-described structure and electrical connection is addressed is that in xerographic corona transfer systems it has been found that the charges placed on the copy sheet by the transfer and/or detack corona generators are, for certain conditions and copy sheet materials, conducted laterally to a significant degree along the paper. That is, copy sheets with relatively low resistivity can conduct the output of the transfer corona generator laterally along through the paper to grounded metal machine components which are in contact with the paper while it is being charged by the transfer corona generator, such as the sheet guides 30 and vacuum shoe 42 here. This separate ground path for the output of the transfer corona generator lowers the effective peak applied charge on the copy sheet by causing a portion of the applied charge concentration under the transfer corotron to flow away laterally therefrom. This can result in a loss of transfer efficiency and/or hollow characters by reducing the maximum transfer field which can be generated for the same applied charge. Note, e.g., U.S. Pat. No. 2,847,305, issued Aug. 12, 1958, to L. E. Walkup. It also affects the accuracy of the dynamic transfer corona generator curent measurement system by the circuitry disclosed herein, in that while the current level sensed at point D does represent the total output of the transfer corona generator 32, it does not represent, in this situation of lateral paper current conduction to grounded surfaces, the actual charge remaining on the copy sheet to accomplish transfer.

With the transfer arrangement disclosed herein, all machine components which would otherwise provide a ground leakage path for the transfer charge through lateral conduction of the copy sheet are allowed to remain at substantially ground potential, and receive such leakage currents, but these leakage currents are all fed to the feedback circuit 35 where they are treated in the same manner as currents to the shield 33. Thus, they are effectively subtracted from (not counted as a part of) the output current of the transfer corotron 32. Thus, the current measured at point D represents only that portion of the output of the transfer corotron 32 which is applied to the copy sheet 26 or 26A here and which is retained thereon, i.e., which not conducted off through the contact of the sheet with any machine components while the sheet is under the transfer corotron.

Where an automatic feedback and control circuit 37 is provided for the transfer power supply 36, as shown, corresponding to the feedback control 65 for the corona generator 14, this control circuit 37 sees this additional loss of current from the corona generator electrode to the components 30 and 42 as if there were an additional loss of current from the corona electrode to the shield 33, and automatically compensates for it by increasing the corona electrode current, thereby increasing the charge applied to the copy sheet under the transfer corotron to at least partially compensate for the loss of this charge through lateral copy sheet conduction. This arrangement is an improvement in the basic measurement and control scheme for the other corona generators disclosed herein, which improvement is fully integrally compatible with such measurement and control and provides an additional novel function.

It will be appreciated that it is known to have xerographic rollers or other copy sheet contact members insulated from ground to prevent charge loss therethrough. U.S. Pat. No. 3,850,519, issued Nov. 26, 1974, to D. J. Weikel teaches a dielectrically coated transfer shield and sheet guide member. Its' substrate is shown grounded, but it is stated that it may alternatively be voltage biased. Likewise, it is known to change a corona generator output in response to a change in the resistivity of the surface being charged, e.g., U.S. Pat. No. 3,554,161, to R. G. Blanchette. This U.S. Pat. No. 3,554,161 discloses a ground path for the shield of a developer corona generator, which ground path is conducted through part of the photoelectric recording member itself so as to change the voltage level of the shield in response to resistance changes in that recording member, and therefore to change the corona output.

The above described control of the output of the transferring corotron 32, or other corona generator, can be particularly desirable where such a corona generator is voltage sensitive. That is, where the dynamic current output of the corona generator is increased by a decrease in the potential of the surface which it is charging. In the case of the transfer corotron 32 this output-influencing potential is the charge on the paper-toner-air-photoreceptor sandwich under the transfer corotron 32. This potential is reduced by the above-described lateral current leakage of the charge by the copy paper away from the area under the transfer corotron. The lateral conduction of transfer charges is quite significant for papers which have been in a high relative humidity environment or which have low surface resistivity. Yet if the transfer corona generator output is allowed to increase too greatly, (in an attempt to maintain a desirable level of peak transfer field intensity under the transfer corotron) the lateral charge conduction of the sheet will carry these charges along the sheet into the pre-transfer area of the sheet which has not yet made contact with the imaging surface. This causes a transfer field acting on an area of the copy sheet prior to that area of the copy sheet engaging the imaging surface. This can cause undesirable air gap pre-transfer or "toner jumping," which can result in fuzzy or blurred images. The undesired pre-transfer condition, therefore, imposes a limitation on the extent to which the output current of the transfer corona generator 32 can be raised to compensate for the drop in peak transfer potential on the copy sheet caused by a lateral conduction. With the feedback control arrangement shown here the transfer output current can be held constant, or caused to increase only within pre-set limits, or at a pre-set rate, in response to the potential under the corona generator.

Referring now to the disclosed switching arrangement for selectively switching between the measurement taps A through F of FIG. 1 to individually measure the corona generator current, there is disclosed in FIG. 2 exemplary circuitry therefor merely by way of one example. It may be seen that this circuitry comprises a three deck wafer switch 100 with common shaft rotation of the individual wiper arms on each wafer deck. The three wafer decks here are designated 101, 102, and 103 and their respective wiper arms are 105, 106, and 107. The inputs of the switch 100 are leads connecting to the respective measurement points A through F, as indicated, plus any other elements inputs to be measured. The output here is through a lead 200 from wiper arm 106 to a measurement circuit 202. The switch 100 and measurement circuit 202 here are arranged to separately sample, hold, and measure the A.C. and D.C. current components of each corona generator current separately.

As noted above, with the circuitry disclosed in FIG. 1, each individual corona generator's plate current, i.e., its actual charge output, may be individually measured at its respective measurement tap even though any or all of the other corona generators are operating. The output of any individual corona generator can be measured with the machine operating in its normal operating state. These current levels measurements can be taken instantaneously, so called, by sampling and storing the instantaneous current levels in storage means such as provided in the circuit 202 here, or on an oscilloscope trace, etc.. These instantaneous current measurements are desirable for such diagnostics as observing the effects of the movement of different copy sheets through the transfer area, or observing the effect on the output of corona generators due to changes in the images being developed, etc..

With the circuitry shown here a single common current measurement ciruct 202 can be utilized, rather than requiring separate current measurement devices for each corona generator. The switching arrangement 100 provides for the switching of this common current measurement circuit 202 between selected individual corona generator power supplies in their current measurement path to the imaging surface grounded substrate. It further provides means for separating and separately measuring the D.C. and A.C. components of said output current of the individual corona generators. This is accomplished here by providing an inductive filter 300 and a capacitive filter 302 and a switching arrangement for selecting therebetween for separating and separately measuring the D.C. and A.C. components of the corona generator output current. This switching arrangement for switching between the two filters 300 and 302 is here an integral part of the overall switch 100, being provided by the wafer decks 102, the wipers 106 and 107, and their connecting circuitry.

It will be appreciated that numerous other arrangements may be utilized in lieu of the switching arrangement 100 and measurement circuit 102 connecting therewith. For example, individual current meters could be placed directly between the low voltage side of each corona generator power supply and ground. That, of course, would add considerable additional expense. In that case, there would be no resistance elements, e.g., no resistors 56 and 58 in this measurement current path, other than the internal current meter resistance. Another alternative measurement system would be to provide a wafer switch connection directly with the low voltage side of each power supply, in which the switch would contain a shorting ring which would directly ground all of the power supplies except the one being measured. The one corona generator power supply being measured would be switch connected to a single common measurement resistor. I.e., one current measurement resistor would be switched between power supplies rather than being provided as a separate resistor for each individual power supply ground path as is disclosed here. The measurement function would be essentially the same since each power supply would be separated from ground by the measurement resistor while it is being measured. As previously noted, the desired value of this current measurement resistor is very low in comparison to the corona generator output impedance, so that its presence or absence in the power supply circuit would have little or no effect on the corona generator output.

The provision disclosed here of separate fixed ground path resistors for each corona generator power supply is preferred, however, since this prevents arcing or voltage build-up between the low side of any power supply and ground. With a fixed resistance in place there can be no interruption in the ground current path regardless of the condition or position of the switch unit selecting between the corona current measurement points. Likewise, the switch or measurement circuit are never subjected to a high voltage. In fact, all of the reference points A – D can be maintained at all times at less than 1 volt above ground, if desired.

A pre-settable fixed reference voltage source may be built into the individual power supplies or into a common reference voltage point, if desired. For measurement or power supply regulation purposes a comparison may be made between this reference voltage (rather than ground) and the current responsive voltage point A through F or the like.

It will be appreciated that a separate current measuring resistor and output tap or other current measuring arrangement may additionally be placed in the shield current feedback lead. This would provide a separate direct measurement of the shield current if it is desired for any reason.

Referring now to the exemplary switching and common measurement circuit of FIG. 2, the output current sensing resistors in each power supply circuit (corresponding to the resistor 58 for the corona generator 14) may all be pre-set to a suitable calibrated value for measurement purposes. For measurement of the output of any particular corona generator the switch 100 is merely turned to a position selecting that desired corona generator. The switch unit 100 here is illustrated in a position connected to the output point C from the pre-transfer corona generator 24. It may be seen that switch deck 101 provides two different adjacent switch positions in which its wiper arm 105 is connected to this same output tap C. In both of these switch positions the voltage sensed at point C is applied through the capacitor 302 and inductive choke 300, which are in parallel. Exemplary values for these could be an approximately 1 microfarad or greater audio capacitor for the capacitor 302 and a conventional audio high impedance choke coil for the inductor 300. The A.C. components of the voltage present at tap C are connected via capacitor 302 to the outere contact ring 109 of the wafer deck 102. The D.C. component of the voltage at point C is passed through the inductor 300 to the inner contact ring 110 of the same wafer deck 102. The wiper 106 alternately connects in each switch position with the contact ring 109 or 110. In the illustrated solid position of the wiper 106 it is shown connecting with the inner contact ring 110. Thus, in this position the output lead 200 of the switch unit 100 is connected only to the D.C. component of the input signal received through the choke 300. In the very next position of the switch 100, shown by the dashed positions of the wipers, the output lead 200 is connected only to the A.C. component of the same input signal C through the capacitor 302.

Meanwhile, the third wafer deck 103 provides alternate connection to ground through its wiper 107 of the alternate signal component which is not being measured at the output lead 200. Itw wiper 107 connects to ground and its inner and outer contact rings are connected in parallel with the rings 109 and 110, respectively, of deck 102. For example, here the wiper 107 is shown connecting the A.C. signal component from capacitor 302 to ground while the D.C. component is being measured. The opposite occurs at the next switch position.

It will be appreciated that this separation of A.C. and D.C. components for measurement may not be desirable in all cases. It will also be appreciated that it could be accomplished by different circuit arrangements, such as a double-pole, double-throw switch associated with the two filters.

Considering now the measurement circuit 202 here, this circuit illustrates a more sophisticated measurement circuit providing output isolation by means of operational amplifiers 204 and 206, and also a sample and hold function provided by these operational amplifiers together with a selectively actuable switch 205 and storage capacitor 208. The switch 205 here is shown as a relay which may be actuated from a switching signal input at 210, either manually or in response to a machine logic signals, to measure an instantaneous input voltage on the input lead 200 at any desired time. When the switch 205 is closed the input voltage is applied to and stored on the capacitor 208 at whatever level was present when the switch 205 is reopened. This voltage may then be read at leisure, due to the isolation provided by the second integrated circuit 206, on a conventional service voltmeter 212 or the like. It will be appreciated, of course, that this output voltage measurement may be utilized in either analogue or converted digital form for various machine control functions, as previously noted.

The sample and hold circuit here allows a measurement to be taken of the output of any selected corona generator or other biasing means at any point in the xerographic machine cycle. By using logic pulses within the existing machine logic controls, which correspond to given machine inter-cycle points or operating conditions, to intermittently pulse the switch 205 here through its relay input 210, very accurate selection of machine cycle points can be made, and comparisons can be made between the same cycle points of different machine cycles. As one example, the D.C. component of the pre-transfer corona generator output being measured here can be measured at the moment the developed image lead edge passes thereunder by pulsing the switch 205 in response to the machine logic signal indicating the feeding of the copy sheet into the transfer station.

A conventional adjustable time delay circuit for delaying the actuation time of the switch 205 can be utilized in a known manner if a machine logic pulse is not available at the precise measurement moment desired. The operational amplifiers 204 and 206 can be provided here by a single commercially available dual op amp integrated circuit.

It will be appreciated that the illustrated type of sample and hold circuit of the measurement circuit 202 here is for D.C. voltage levels. Where the A.C. current component is being measured, this could, of course, be measured directly by an A.C. volt meter at the switch output lead 200. Alternatively, the integrated circuit 204 can be connected to provide rectification of the A.C. input signals to D.C. Alternatively, a conventional diode rectifier bridge can be utilized to convert the A.C. current level to a D.C. level, or active filtering circuits can be utilized.

Because the fixed connection ground path resistors 58 et al provide a low impedance and are parallel with the current measurement circuit here, the outputs of the corona generators are not affected by the switch connection interchanges or changes in the impedance of the measurement circuit. Also, it will be appreciated that these ground path resistors may be the regulator resistors already available within the power supply circuitry itself, and that the measurement circuit can be an integral part of the power supply.

It will be appreciated that with the circuitry disclosed herein, that any of the shield, output or lead currents can be measured or controlled individually or in any combination, since they are maintainable in separate or combined current paths from which measurement and/or control signals can be derived. The disclosed regulator circuitry, e.g., feedback resistor 56 and feedback path 65, can, as described automatically maintain the actual corona generator output current constant. Thus any corona generator can be made effectively voltage insensitive, if desired. The corona output charge will thereby not fluctuate even with changes in the charge already on the imaging surface. However, in some cases it may not be desirable to keep the output constant, i.e., imaging surface voltage sensitivity is desired. Thus, for the charging corona generator 14 there is illustrated in dashed lines an alternative shield current feedback lead 62, a connection between resistances 56 and 58. With this alternate connection the output tap A still provides the same measurement of only the corona output through measurement resistance 58, but the regulation lead 65 now senses the sum of the output current and the shield current, since both now return to the power supply through regulator resistor 56. Thus, the power supply 54 is now regulated to maintain the sum of shield current plus output current constant rather than to maintain only the output current constant.

In conclusion, there has been disclosed herein an improved corona generator output current measurement system, and automatic control means therefor. Numerous advantages and applications, in addition to those described above, will be apparent to those skilled in the art. While the embodiments generally disclosed herein are generally considered to be preferred, numerous variations and modifications will be apparent to those skilled in the art. The following claims are intended to cover all such variations and modifications as fall within the true spirit and scope of the invention.

What is claimed is:

1. In an electrostatographic copying apparatus having an imaging surface with an electrically grounded substrate and a plurality of separate corona generators which have corona emitting electrodes shielded with conductive shields, and which function to apply an output current of electrical charges to said imaging surface, wherein appropriate power supply means are electrically connected to said corona generators for providing a selected input current to each said corona generator, and wherein a variable portion of said input current to each of said corona generators flows to the respective shield of said corona generator, the improvement wherein:

each of said corona generator shields is individually electrically isolated from one another and from said imaging surface and from ground, a feedback circuit connects with each of said corona generator shields, said feedback circuit is electrically isolated from said imaging surface and from ground, said feedback circuit feeds said variable portion of said corona generator input current flowing to said shield back to said respective power supply means for said corona generator; and current measurement means are connected between each of said power supply means and said grounded substrate of said imaging surface for independently measuring only said output current flowing between each individual said corona generator and said imaging surface independently of said current flow to said shield, and independently of said input current and independently of the output current flow of other corona generators to said imaging surface.

2. The apparatus of claim 1, wherein said current measurement means comprises a common current measurement circuit and switching means for switching said common current measurement circuit between selected individual said power supplies and said imaging surface grounded substrate.

3. The apparatus of claim 1, wherein said current measurement means includes means for separating and separately measuring D.C. and A.C. components of said output current of said individual corona generators.

4. The apparatus of claim 1, wherein said current measurement means includes D.C. filter means and A.C. filter means and switch means for selecting therebetween for separating and separately measuring the D.C. and A.C. components of said output current of said individual corona generators.

5. The apparatus of claim 3, wherein said current measurement means comprises a common current measurement circuit and switching means for switching said common current measurement circuit between selected individual said power supplies and said imaging surface grounded substrate.

6. The apparatus of claim 4, wherein said current measurement means comprises a common current measurement circuit and switching means for switching said common current measurement circuit between selected individual said power supplies and said imaging surface grounded substrate.

7. The apparatus of claim 5, wherein said switching means for switching between selected power supplies and said witch means for switching between inductive and capacitive filter means are integrally connected to selectively sequentially measure the D.C. and A.C. components of selected corona generators.

8. The apparatus of claim 2, further including biased electrode means for applying an electrical bias to said imaging surface, and wherein said switching means includes a further switch position for the connection of said biased electrode means to said current measurement means.

9. The apparatus of claim 1, further including individual resistance means connecting between individual said power supply means and electrical ground, and further including second feedback circuit means connecting between said resistance means and said power supply means for controlling said power supply means to maintain a selected pre-set said output current from individual said corona generators.

10. The apparatus of claim 9, wherein said resistance means has an adjustable level output connection with said second feedback circuit means to control said selection of said pre-set output current from said corona generator.

11. The apparatus of claim 1, wherein at least one of said corona generators has an electrical lead connecting between said power supply means therefor and said corona emitting electrodes thereof, which electrical lead has an electrical shield, and wherein said electrical shield is connected to said feedback circuit and is electrically isolated from ground to feed back any currents induced in said electrical shield from said electrical lead back to said power supply means.

12. The apparatus of claim 1, wherein said feedback circuit provides a shield current return connection to said power supply between said power supply and said measurement circuit, electrically separated from said grounded substrate by said measurement circuit.

13. The apparatus of claim 1, wherein each said power supply means connects to said electrically grounded substrate through connecting low resistance means with a current measurement tap and wherein said feedback circuit connects said corona generator shield between said current measurement tap and said power supply means, so that said resistance means is between said feedback circuit and said electrically grounded substrate.

* * * * *